US006824647B2

(12) United States Patent
Neveu et al.

(10) Patent No.: US 6,824,647 B2
(45) Date of Patent: Nov. 30, 2004

(54) METHOD FOR MARKING A SHEET OF PAPER AND SHEET WITH A WATERMARK

(75) Inventors: Jean-Louis Neveu, Colmar (FR); Nicolas Pommier, Colmar (FR); Joël Hungler, Ailly (FR)

(73) Assignee: Georgia-Pacific France, Kunheim (FR)

( * ) Notice: Subject to any disclaimer, the term of this patent is extended or adjusted under 35 U.S.C. 154(b) by 0 days.

(21) Appl. No.: 10/435,559

(22) Filed: May 12, 2003

(65) Prior Publication Data

US 2004/0007338 A1 Jan. 15, 2004

(30) Foreign Application Priority Data

May 14, 2002 (EP) ..... 02010746

(51) Int. Cl.[7] ..... D21H 27/02; B44C 1/24; B31F 1/07

(52) U.S. Cl. ..... 162/110; 162/140; 162/134; 162/158; 162/135; 283/113

(58) Field of Search ..... 162/109–113, 116, 162/117, 140, 134, 135, 158; 156/209, 219; 428/156, 171, 172; 283/113

(56) References Cited

U.S. PATENT DOCUMENTS

| | | | | | |
|---|---|---|---|---|---|
| 717,799 | A | * | 1/1903 | Benhrend et al. | 162/110 |
| 1,455,752 | A | * | 5/1923 | Lucey | 162/110 |
| 1,883,526 | A | * | 10/1932 | Bryan | 162/117 |
| 2,370,186 | A | * | 2/1945 | Oldofredi | 101/28 |
| 3,048,100 | A | * | 8/1962 | Livingston | 101/491 |
| 3,076,689 | A | * | 2/1963 | Taylor | 8/119 |
| 3,478,141 | A | * | 11/1969 | Dempsey et al. | 264/284 |
| 4,135,024 | A | * | 1/1979 | Callahan et al. | 428/171 |
| 4,462,866 | A | * | 7/1984 | Tooth et al. | 162/103 |
| 4,526,652 | A | * | 7/1985 | Waters | 162/110 |
| 4,720,325 | A | * | 1/1988 | Rausing et al. | 162/110 |
| 4,760,239 | A | * | 7/1988 | Makin | 219/121.85 |
| 4,919,044 | A | * | 4/1990 | Lafler | 101/141 |
| 4,919,144 | A | * | 4/1990 | Vandehey | 600/518 |
| 2004/0007338 | A1 | * | 1/2004 | Neveu et al. | 162/110 |

FOREIGN PATENT DOCUMENTS

| | | | | |
|---|---|---|---|---|
| DE | 3700649 A1 | * | 7/1988 | B26F/1/42 |
| EP | 411546 A1 | * | 2/1991 | A47J/31/06 |
| EP | 446138 A1 | * | 9/1991 | B31F/1/07 |
| EP | 503919 A1 | * | 9/1992 | B41M/3/10 |
| GB | 2264672 A | * | 9/1993 | B41M/3/10 |
| WO | WO 9406623 A1 | * | 3/1994 | B31F/1/07 |
| WO | WO 9720107 A1 | * | 6/1997 | D21H/27/02 |

* cited by examiner

*Primary Examiner*—José A. Fortuna
(74) *Attorney, Agent, or Firm*—Breiner & Breiner, L.L.C.

(57) ABSTRACT

A method for marking a watermark-type pattern onto at least part of an absorbent paper sheet is described. The method involves stress-deforming the sheet by making it pass between at least one first roll and at least one second roll. A film of additive is applied in unheated manner to at least one of the sheet surfaces during the marking stage, thereby enhancing watermark formation. Additionally described is an absorbent paper sheet including at least one cellulose web ply which is made by the above method.

25 Claims, 2 Drawing Sheets

METHOD FOR MARKING A SHEET OF PAPER AND SHEET WITH A WATERMARK

The present invention relates to sanitary or household papers. It applies for example to toilet paper, paper towels and any paper used for wiping, table napkins, etc.

In general cellulose webs, also called tissue paper, are used in manufacturing these products. This is an absorbent paper of low specific surface weight between 10 and 45 g/m$^2$ made by a wet method from paper fibers. This paper also may include low proportions of chemical additives according to the intended application. It may be made by pressing the still wet web on a heated large diameter cylinder which dries the sheet which is then removed using a metal blade applied to the cylinder transversely to its direction of rotation. The purpose of this procedure is to crepe the web which then exhibits corrugations running transversely to its direction of advance. Creping imparts some elasticity to the sheet while also increasing its thickness and imparting to it properties of hand. Another known mode of manufacture comprises a first and at least partial sheet drying stage using a cross-flow of hot air. The sheet then may be creped or not.

The object of the present invention is marking a sheet consisting of one or more cellulose plies to create a pattern which simulates a watermark.

The expression "marking" used herein denotes the compression of given parts of one side of the sheet in order to produce thereby compacted zones and to significantly reduce its thickness in the zones without thereby forming corresponding salients on the opposite side of the sheet.

A watermark is a design printed into the thickness or body of paper and is visible when viewed for transparency. A watermark is called "wet watermark" or "true watermark" when it is introduced during paper manufacture, in the wet process and before drying. Illustratively a wet watermark is made by printing a pattern present on a rotating cylinder in contact with the still wet sheet.

A "simulated" or "dry watermark" results from an imprint, which looks similar to a "genuine watermark", applied to paper after its manufacture. A number of different implementing modes already have been proposed, however, they generally relate to applications other than sanitary or household papers.

In its European Patent B 0 864 014, applicant proposed applying a pattern similar to a watermark to an absorbing cellulose web. This procedure consists in deforming the stressed sheet by making it pass between a hard engraved roll and a mating roll exhibiting a hardness greater than 40 Shore D at a pressure of at least 150 kg/cm$^2$ at a marking rate of at least 50 m/min. Preferably the engraved cylinder is made of steel and it is heated to a temperature between 50° C. and 100° C. Some modest amount of water may be added.

This procedure allows making a product with a pattern simulating a watermark, the marked surface being smooth, glossy and translucid, the product thickness being small compared to the other dimensions. Applicant has endeavored improving this procedure and in particular to make high contrast watermarks without requiring heating means.

This object is attained by the method of the invention.

The method of the invention for marking a watermark-simulating pattern onto a sheet composed of at least one ply of cellulose web and consisting in deforming by stressing the sheet between a first rigid roll having a smooth surface and at least one second rigid roll fitted with salient elements is characterized in that a film of additive enhancing watermark formation is added in an unheated manner to at least one of the sheet's sides during marking.

Preferably, the additive is based on mineral oil. The additive is applied to the surface and enters the sheet's thickness while the sheet is being deformed. It is applied in an unheated manner, that is without application of external heat, at ambient temperature. In this manner, optimal results are attained using simple means.

Preferably the additive is applied to the first roll, to the salient elements of the second roll, or to both rolls. In the latter case, the decoration is very visible both on the marked side and on the opposite side.

Different ways of applying the additive may be considered: coating, spraying, atomizing in particular. As regards spraying, the additive may be applied directly on the roll(s) during marking. However, in an advantageous implementation of the invention, the additive may be applied by coating. Coating may be carried out using apparatus fitted with a screened cylinder. In the description below, the additive is applied by contact between the surface(s) to be coated, in this instance the roll(s), and an absorbent means is impregnated with the additive. The additive is then transferred from the surface(s) of the roll(s) to the surface(s) of the sheet during the marking operation.

A small quantity of additive is enough for application so that the finished product contains less than 1% by weight, preferably between 0.2 and 1% and, in particular, between 0.2 and 0.5% by weight of additive relative to the weight of the sheet.

Preferably the additive is a white mineral oil used for medical or nutritional purposes. Its dynamic viscosity at ambient temperature (about 25° C.) is between 15 and 80, preferably between 20 and 30 mPa.s as defined in standard NFT60-100.

This method allows creating varied patterns. In particular the salient elements of the second roll constitute pattern units subtending an area between 20 and 50 mm$^2$, preferably between 30 and 40 mm$^2$. In particular salient elements comprise continuous segments of linear form. Preferably the ratio of the marked surface to the total sheet surface is less than 20%.

Moreover, a force is exerted on the second roll and corresponds to a linear pressure on the sheet of approximately between 20 and 100 kg/cml, preferably between 40 and 90 kg/cml.

In one advantageous implementation of marking to make a sheet of which the (machine) width in particular is between 250 and 3200 mm, the sheet is deformed between a first roll which is the width of the sheet and at least one second roll of a width between 15 and 90 mm.

In particular, a plurality of second rolls are arrayed along the length of the first roll. Each roll may be an assembly of several disks.

The manufactured sheet comprising at least one ply of cellulose web of a specific surface weight between 10 and 45 g/m$^2$ and exhibiting a marked zone simulating a watermark is characterized in that it is impregnated with an additive, in particular a mineral oil additive. Advantageously the proportion of additive is less than 1% by wt. relative to the weight of the sheet.

The invention is elucidated by the following description which is wholly illustrative and does not imply limitation and in relation to the attached drawings.

Figure 1:
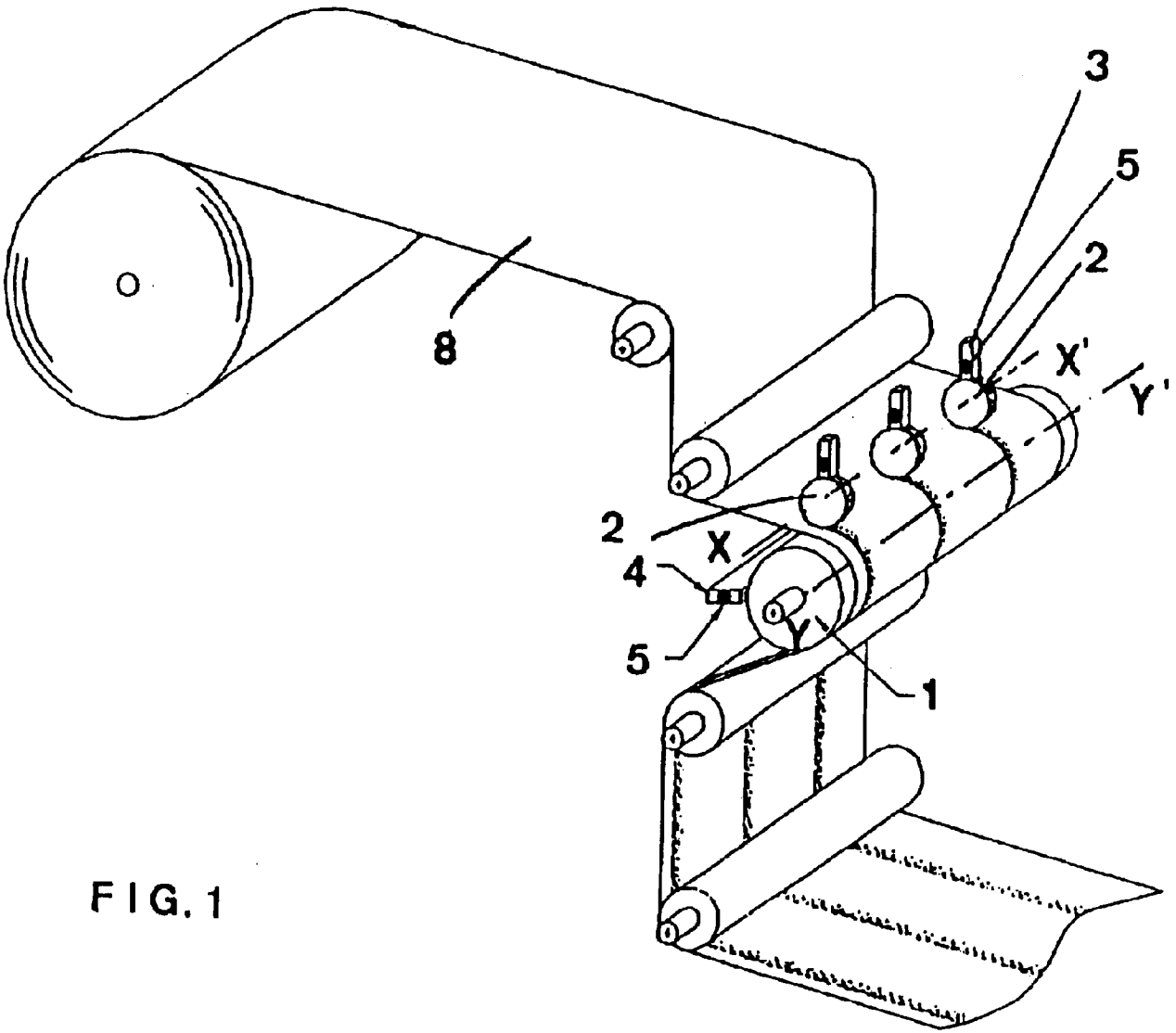
FIG. 1 is a schematic perspective of one embodiment of the invention.

As shown in FIG. 1, a sheet 8 composed of at least one cellulose web ply, in this example there are two plies, is wound off at least one spool. The sheet is guided by means of at least one (unreferenced) guiding or deflecting roll to pass between a first roll 1 having a smooth surface and a plurality of second rolls 2 fitted with salient elements. The axis of rotation of the first roll is YY'. The rolls 2 are engraved and illustratively are mounted along a common axis XX' which runs parallel to YY'. Within the scope of the present invention, the second rolls 2 may be configured along two or more parallel axes. Moreover they may be configured along two diametrically opposite axes, thereby securing the advantage of better balancing the stresses applied to the first roll 1. The second rolls 2 each may be of a width between 15 and 90 mm. They may be spaced mutually apart to shape decorative strips into the sheet being processed.

The salient elements on the engraved wheels 2 exhibit a continuous and complex shape or they may consist of continuous (open or closed) sets. Within the scope of the present invention, the knurls 2 may be linked in a way to subtend a pattern over all or part of the sheet's surface. The sheet 8 is compressed between the rolls 1 and 2. Means are provided to apply a force on the second rolls that corresponds to a linear pressure between 20 and 100 kg/cml, preferably between 40 and 90 kg/cml.

Also, at this stage, the sheet 8 will be covered on at least one of its surfaces with a mineral-oil based additive, such as VASELINE. In a preferred implementation, a white oil, whether mineral, medicinal or nutritional is used in any way appropriate for applications entailing direct, indirect or occasional food contact. Illustratively, an oil such as that marketed as PRIMOL or MARCOL by ESSO SAF is used. This is a colorless liquid of which the dynamic viscosity at 25° C. advantageously is between 20 and 25 mPa.s.

Means 3 and 4 apply the additive. These means may coat either the engraved rolls 2 or the smooth roll 1, or both kinds. Depending on the case, they make contact with one and/or the other of the rolls.

The means 3 and 4 may be any known kind, being fitted with a source 5 for the additive and an absorbing material allowing transfer of the additive from the source to the associated roll 1 or 2. The absorbent material may be based on textile fibers at a density between 200 and 450 g/m$^2$/mm, for instance 225 g/m$^2$/mm.

As regards the smooth roll 1, the additive preferably is applied over its full contacting surface and is directed along the generatrix.

As regards the engraved rolls 2, and using the above coating means, the peaks of the salient patterns are coated with additive. The method of the invention is especially advantageous as regards equipment undergoing stoppage after winding a log or rolls, the equipment being known in the field as being "stop and go".

Figure 2:
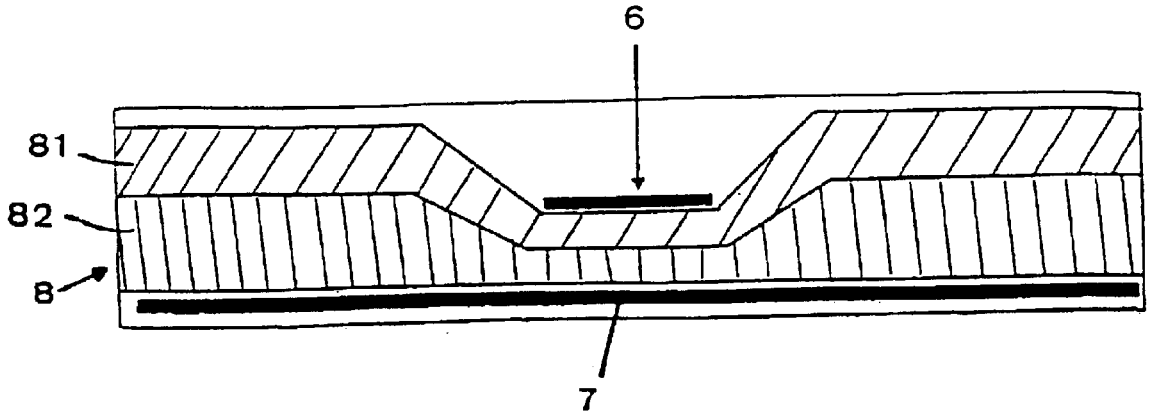
FIG. 2 is a cross-section of the sheet manufactured in the manner of the invention.

When the two sides of a sheet 8 are totally or partly impregnated with additive, then illustratively a product, such as shown in schematic cross-section in FIG. 2, fitted with two additive layers 6 and 7 may be manufactured. Advantageously this double additive application enhances visual contrast of the marked patterns. Visual appearance and aesthetics are reinforced by the mechanical compression exerted by the second means 2 against the sheet being processed which, in this stage, is impregnated with the mineral oil-based additive and which rests against the first means (smooth roll 1).

Moreover and in novel and unexpected manner, the visual contrast is actually enhanced when the proportion of deposited additive, which can be measured on the sheet, is less than 1% by wt. relative to the total weight of the sheet.

This proportion not only allows attaining an enhanced visual contrast but also averts creating spots or traces around the pattern edges. Accordingly, the quality of the product pattern is excellent.

Illustratively the pressure at which the means 2 is forced against the means 1 is at least 60 kg/cml (kg per linear cm measured along the contact generatrix).

Advantageously the salient element on the rolls 2 subtend areas of about 20 to 50 mm$^2$, preferably 30 to 40 mm$^2$. These elements are configured in such a manner on the second roll 2 that the roll rests continuously on the smooth roll 1 in a manner precluding vibrations.

Figure 3:
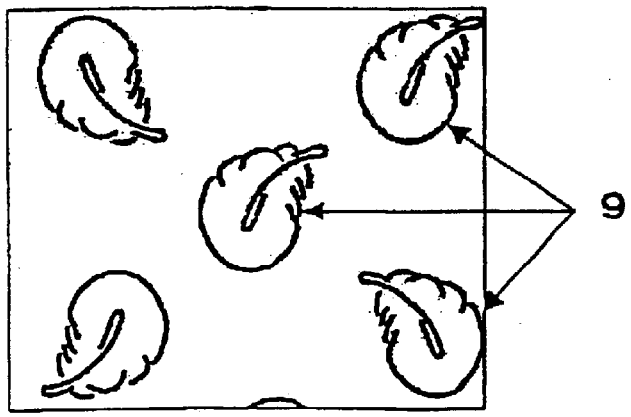
FIG. 3 illustrates the decoration of a sheet of the invention.

The patterns may assume any shape, linear or not. FIG. 3 illustrates the case of dark, feather-like patterns 9 against a light background. Actually, as regards a cellulose web sheet, the patterns do contrast against the background of the sheet 8.

The sheet 8 may consist of one or several plies. In the latter case, the plies link up in the decorated zones. The method of the invention allows decorating very wide sheets. One decorative example is shown in FIG. 3.

In that case, one appropriate implementation of the invention consists in using at least one first set of engraved means 2 arrayed along a first axis XX' and a second set of engraved means configured along a second axis, parallel to but different from the first axis (XX'), these axes being parallel to the YY' axis of the smooth roll 1. The first and second axes of the second engraved means illustratively may be configured diametrically opposite with respect to the smooth roll 1. The engraved means, for example knurled wheels, are configured on each of the first axes (XX') and at a given distance from each other. Therefore, in case of damage or wear, a wheel may be easily replaced. When the engraved rolls 2 are configured along two axes, they are preferably staggered relative to one another.

The objects to be included in the present invention illustratively are sanitary paper rolls, table napkins, paper towels or paper towels for industrial use. As regards products such as paper towels or table napkins, localized decoration, for example along the rim of the product, may be used.

As regards sanitary paper, or paper used for industrial wiping, on the other hand, decoration may be spread across the full surface of the product of the invention.

Tests were run on applying an additive, in this instance MARCOL 82 oil, using equipment such as shown in FIG. 1, and coating the rolls 1 and 2. The marking pressure was 60 kg/cml. The sheet's speed of advance was 100 m/min.

The paper image was analyzed in the marked and unmarked zones. In this manner the contrast and the visibility of the watermark can be determined on the basis of the differences in measured gray intensities. This method is borrowed from applicant's European Patent B1 0 864 014. The Table below shows the results.

Lastly, the quantity of additive impregnating the sheet, that is the % by weights of additive in the sheet that was measured in such conditions on the described apparatus. The gravimetric measurement took the form of extracting the additive using chloroform. This method will be referred to below.

One control sample with additive and another without additive are made. Four g of paper are introduced into an extraction cartridge. The additive is solvent-extracted using 50 ml of chloroform in an automated "Soxlhet" instrument. Following one half hour of soaking and 1 h of rinsing, the solvent is evaporated and the rate of extraction is quantified. The proportion of additive is the proportion of extract from the additive-treated sample less the proportion of extract from the additive-free sample. The Table below lists the measured additive quantities in %.

The sheet thickness is determined under the ENV 12625-3 standard. This-thickness is not increased by the method of the invention. The unmarked thickness of the basic sheet is approximately 0.224 mm.

TABLE

| Linear pressure, kg/cml | Sheet's speed, m/min | Sheet thickness, mm | Difference in gray intensities surface 6 | surface 7 | Additive, % |
|---|---|---|---|---|---|
| 43.75 | 100 | 0.226 ± 0.01 | 34 | 36 | 0.37 |
| 65.62 | 100 | 0.237 ± 0.01 | 56 | 54 | 0.45 |
| 87.5 | 100 | 0.239 ± 0.01 | 60 | 54 | 0.35 |

The differences between the measured gray intensities of each side illustrate the good pattern visibility simulating a watermark. A watermark was observed both on the side contacting the smooth roll and on the side contacting the engraved rolls.

The method described in the European Patent 864 014 uses fiber optics and a light diffuser to illuminate the sheet and measures the gray intensities using a CCD camera and a Leica Quantilet 600S image analyzer. Parameters such as brightness and contrast are set. A surface is confined to define an image. The image is divided into pixels. Each pixel of this surface has a gray intensity. The mean value of all image pixels is the mean value of the surface's gray intensity. On the gray scale, white is at a level of 256 and black at 0. The mean of the gray intensity of a marked surface is measured by bounding a small closed zone. Next an unmarked zone of corresponding area is bounded near the marked zone and the mean gray intensity is measured. The differential of the means of the two images is calculated and entered into the above Table. A watermark is considered present in conventional manner when the differential of the gray intensities exceeds 20.

It is claimed:

1. A method for marking a watermark-simulating pattern onto a sheet comprising at least one ply of a cellulose web, said method comprising deforming under stress said sheet against a rigid first roll exhibiting a smooth outer surface and at least one rigid second roll having salient elements, and applying in an unheated manner a film of additive material in such a manner so as to enhance watermark formation on at least one side of the sheet, wherein the additive material comprises mineral oil.

2. Method as claimed in claim 1, wherein the additive material is applied to the first roll.

3. A method for marking a watermark-simulating pattern onto a sheet comprising at least one ply of a cellulose web, said method comprising deforming under stress said sheet against a rigid first roll exhibiting a smooth outer surface and at least one rigid second roll having salient elements, and applying in an unheated manner a film of additive material in such a manner so as to enhance watermark formation on at least one side of the sheet, wherein the additive material is applied to the salient elements of the second roll and wherein said additive material comprises mineral oil.

4. A method for marking a watermark-simulating pattern onto a sheet comprising at least one ply of a cellulose web, said method comprising deforming under stress said sheet against a rigid first roll exhibiting a smooth outer surface and at least one rigid second roll having salient elements, and applying in an unheated manner a film of additive material in such a manner so as to enhance watermark formation on at least one side of the sheet, wherein the additive material is applied to the salient elements of the second roll and wherein said additive material comprises mineral oil.

5. Method as claimed in claim 1, 3 or 4, wherein the additive material is applied by spraying, atomizing, coating, or by contact with an absorbent means impregnated with said additive material.

6. Method as claimed in claim 1, 3 or 4, wherein less than 1% by wt. but greater than zero of additive material is applied relative to said sheet.

7. A sheet comprising at least one cellulose web ply having a specific surface weight between 10–45 g/m$^2$, said sheet being manufactured according to the method of claim 6, said sheet exhibiting a marked zone simulating a watermark.

8. Method as claimed in claim 1, 3 or 4, wherein 0.2–1% by wt. of additive material is applied relative to said sheet.

9. Method as claimed in claim 1, 3 or 4, wherein 0.2–0.5% by wt. of additive material is applied relative to said sheet.

10. Method as claimed in claim 1, 3 or 4, wherein the salient elements of the second roll subtend unit patterns exhibiting a surface of between 20–50 mm$^2$.

11. A sheet comprising at least one cellulose web ply having a specific surface weight between 10–45 g/m$^2$, said sheet being manufactured according to the method of claim 10, said sheet exhibiting a marked zone simulating a watermark.

12. Method as claimed in claim 1, 3 or 4, wherein the salient elements of the second roll subtend unit patterns exhibiting a surface of between 30–40 mm$^2$.

13. Method as claimed in claim 1, 3 or 4, wherein the salient elements comprise segments of a continuous shape.

14. A sheet comprising at least one cellulose web ply having a specific surface weight between 10–45 g/m$^2$, said sheet being manufactured according to the method of claim 13, said sheet exhibiting a marked zone simulating a watermark.

15. Method as claimed in claim 1, 3 or 4, wherein a force corresponding to a linear pressure between 20–100 kg/cml is exerted on the second roll.

16. A sheet comprising at least one cellulose web ply having a specific surface weight between 10–45 g/m$^2$, said sheet being manufactured according to the method of claim 15, said sheet exhibiting a marked zone simulating a watermark.

17. Method as claimed in claim 1, 3 or 4, wherein a force corresponding to a linear pressure between 40–90 kg/cml is exerted on the second roll.

18. Method as claimed in claim 1, 3 or 4, wherein the sheet is between 250 and 3200 mm wide, the first roll runs across a full width of said sheet, and at least one second roll is between 15 and 90 mm wide.

19. Method as claimed in claim 18, wherein the sheet is deformed between the first roll and a plurality of the at least one second roll which are arrayed along a length of the first roll.

20. A sheet comprising at least one cellulose web ply having a specific surface weight between 10–45 g/m$^2$, said sheet being manufactured according to the method of claim 18, said sheet exhibiting a marked zone simulating a watermark.

21. A method for marking a watermark-simulating pattern onto a sheet comprising at least one ply of a cellulose web, said method comprising deforming under stress said sheet against a rigid first roll exhibiting a smooth outer surface and at least one rigid second roll having salient elements, and applying in an unheated manner a film of additive material in such a manner so as to enhance watermark formation on at least one side of the sheet, wherein the additive material is a white mineral oil having a dynamic viscosity at 25° C. of between 15–80 mPa.s.

22. A method for marking a watermark-simulating pattern onto a sheet comprising at least one ply of a cellulose web, said method comprising deforming under stress said sheet against a rigid first roll exhibiting a smooth outer surface and at least one rigid second roll having salient elements, and applying in an unheated manner a film of additive material in such a manner so as to enhance watermark formation on at least one side of the sheet, wherein the additive material is a white mineral oil having a dynamic viscosity at 25° C. of between 20–30 mPa.s.

23. A sheet comprising at least one cellulose web ply having a specific surface weight between 10–45 g/m$^2$, said sheet being manufactured according to the method of one of claim 1, 3, 4, 10 or 11, said sheet exhibiting a marked zone simulating a watermark.

24. Sheet as claimed in claim 23, wherein the additive material is present at a zone of a marked surface in said sheet.

25. Sheet as claimed in claim 23, wherein a marked surface of the sheet relative to total sheet surface is less than 20%.

* * * * *

UNITED STATES PATENT AND TRADEMARK OFFICE

CERTIFICATE OF CORRECTION

PATENT NO. : 6,824,647 B2
DATED : November 30, 2004
INVENTOR(S) : Jean-Louis Neveu et al.

It is certified that error appears in the above-identified patent and that said Letters Patent is hereby corrected as shown below:

Column 5,
Line 7, “This-thickness” should read -- This thickness --.

Column 6,
Line 7, “is applied to the salient elements” should read -- is applied to both the first roll and the salient elements --.

Column 8,
Line 6, “claim 1, 3, 4, 10 or 11,” should read -- claim 1, 3, 4, 21 or 22, --.

Signed and Sealed this

Sixteenth Day of August, 2005

JON W. DUDAS
*Director of the United States Patent and Trademark Office*